US011209201B2

(12) United States Patent
Hosamani et al.

(10) Patent No.: US 11,209,201 B2
(45) Date of Patent: Dec. 28, 2021

(54) ICE MAKER WITH SPECIFICALLY POSITIONED DRIVE UNIT, HOUSEHOLD REFRIGERATION APPARATUS AND METHOD FOR ASSEMBLING AN ICE MAKER

(71) Applicant: BSH HAUSGERAETE GMBH, Munich (DE)

(72) Inventors: Prashantagouda Hosamani, Ulm (DE); Robert Stahl, Herbrechtingen (DE); Mathias Sigl, Herbrechtingen (DE); Jorge Carlos Montalvo Sanchez, Knoxville, TN (US)

(73) Assignee: BSH Hausgeraete GmbH, Munich (DE)

( * ) Notice: Subject to any disclaimer, the term of this patent is extended or adjusted under 35 U.S.C. 154(b) by 177 days.

(21) Appl. No.: 16/203,026

(22) Filed: Nov. 28, 2018

(65) Prior Publication Data

US 2020/0166264 A1 May 28, 2020

(51) Int. Cl.
*F25C 5/20* (2018.01)
*F25C 1/24* (2018.01)

(52) U.S. Cl.
CPC ..... *F25C 5/22* (2018.01); *F25C 1/24* (2013.01); *F25C 5/24* (2018.01); *F25C 2400/10* (2013.01)

(58) Field of Classification Search
CPC ..... F25C 5/22; F25C 5/24; F25C 5/20; F25C 1/24; F25C 2400/10; F25C 5/182; F25D 23/006; F25D 23/065; F25D 23/066; F25D 23/067; F25D 23/12; F25D 23/02
See application file for complete search history.

(56) References Cited

U.S. PATENT DOCUMENTS

| | | | | |
|---|---|---|---|---|
| 3,714,794 | A * | 2/1973 | Linstromberg et al. .. | F25C 1/24 62/137 |
| 3,807,193 | A * | 4/1974 | McKenney ..... | F25C 5/20 62/322 |
| 6,880,355 | B2 | 4/2005 | Jung | |
| 2008/0041089 | A1* | 2/2008 | Choi ..... | F25C 1/24 62/344 |
| 2015/0300718 | A1* | 10/2015 | Bauriedl ..... | F25C 5/22 222/173 |

* cited by examiner

*Primary Examiner* — Tavia Sullens
(74) *Attorney, Agent, or Firm* — Laurence A. Greenberg; Werner H. Stemer; Ralph E. Locher

(57) ABSTRACT

An ice maker for a household refrigeration apparatus has a housing with an opening, through which ice is transportable from an interior of the housing out of the housing, a flap, which is movably arranged in the housing and adjustable for closing or opening the opening, and a drive unit, which is coupled to the flap by a coupling device of the ice maker, to move the flap. The drive unit is formed as a separate module and the entire module of the drive unit is arranged adjacent to the opening in the housing.

15 Claims, 12 Drawing Sheets

ICE MAKER WITH SPECIFICALLY POSITIONED DRIVE UNIT, HOUSEHOLD REFRIGERATION APPARATUS AND METHOD FOR ASSEMBLING AN ICE MAKER

TECHNICAL FIELD

An aspect of the invention relates to a household refrigeration apparatus comprising an ice maker comprising a specifically constructed housing. A further aspect of the invention relates to a method for assembling a housing of an ice maker.

BACKGROUND OF THE INVENTION

Household refrigeration apparatuses are known in diverse configurations. In this context, it is also known that an interior container bounds a receiving space for a household refrigeration apparatus. This receiving space is usually a refrigerating compartment. A partial area is occupied by an ice maker in this receiving space. Thereto, it is known that the ice maker is separated from the remaining volume of the refrigerating compartment. In this context, it is provided that a housing area of the housing of the ice maker is formed by a separate wall element, which is attached to inner sides of walls of the interior container in the interior of the receiving space of the interior container.

From U.S. Pat. No. 6,880,355 B2, a household refrigeration apparatus with an ice maker is known. The ice maker occupies a partial area of the interior volume of a refrigerating compartment, which is a receiving space for food. The ice maker comprises a housing. A drive unit is arranged in this housing, by which a control means is to be actuated. An outlet of the housing is closed or opened by the control means. Ice can be output from the ice maker via this outlet. In the configuration of the ice maker, it is provided that this drive unit is arranged at the rearmost end of the housing viewed in depth direction of the household refrigeration apparatus. However, the control means is arranged at the frontmost end, where the opening is also formed. Thereby, it is required in this configuration to bridge a relatively long path, namely the entire length of this housing of the ice maker measured in depth direction, to provide a mechanical coupling between the drive unit and this control means. In this respect, it is provided that a thin rod drive is formed, which extends over this entire distance. Thereto, this relatively thin and delicate rod is mechanically fixed or suspended at multiple locations. Due to the different positions of the components, it comprises multiply bent areas to be able to allow the mechanical coupling to the drive unit on the one and to the control means on the other hand anyway. Therefore, the coupling distance is formed by a very long element, namely this connecting rod. By such a configuration, however, disadvantages exist to the effect that more space is required, movement transmission from the drive unit to the control means is very inaccurately effected on the other hand. Here, tolerances are given by the large path distance, by which the precision of the movement transmission, which is generated by the drive unit, and is then performed by the control means, is restricted and deviating, respectively. This also results in the fact that the movement of the control means becomes inaccurate and an open position or a closed position of this control means is only achieved to a limited extent. Thereby, problems in passing the ice can occur on the one hand, on the other hand, if this control means is not completely opened, jam of ice in the opening not completely unblocked can occur. Moreover, a loss of stability is also associated with this very thin and delicate connecting rod. This means that the long rod can also deform in itself, for example bend or twist, upon force effect by the drive unit. Thereby too, an insufficient and not complete or not direct transmission of the movement initiated by the drive unit to this control means can be effected. In the configuration of the ice maker from the prior art, a very expensive assembly process is also required due to the plurality of components and the individual positions.

SUMMARY OF THE INVENTION

It is an object of the present invention to provide an ice maker, in which the movements initiated by a drive unit can be transmitted to a flap in improved manner such that opening and closing this flap are improved. Similarly, it is an object of the invention to provide a household refrigeration apparatus with such an ice maker.

Furthermore, it is the object to simplify the assembly of a drive unit in an ice maker.

This object is solved by an ice maker, a household refrigeration apparatus and a method according to the independent claims.

An aspect relates to an ice maker for a household refrigeration apparatus comprising a housing with an opening, through which ice is transportable from an interior of the housing out of the housing. The ice maker comprises a flap, which is movably arranged in the housing and is adjustable for closing or opening the opening. The ice maker comprises a drive unit, which is coupled to the flap by a coupling device of the ice maker to move the flap. The drive unit is formed as a separate module, wherein the entire module of the drive unit is arranged adjacent to the opening in the housing.

A further aspect relates to a household refrigeration apparatus comprising an apparatus housing with a receiving space for food, and an ice maker. The ice maker comprises a housing with an opening, through which ice is transportable from an interior of the housing out of the housing. It comprises a flap, which is movably arranged in the housing and adjustable for closing or opening the opening. The ice maker comprises a drive unit, which is coupled to the flap by a coupling device of the ice maker to move the flap. The drive unit is formed as a separate module, wherein the entire module of the drive unit is arranged adjacent to the opening in the housing.

A further aspect relates to a method for assembling an ice maker for a household refrigeration apparatus, comprising the following steps:

providing a housing of the ice maker;

providing a drive unit of the ice maker as an own, separate module, wherein the drive unit is formed for moving a flap of the ice maker, wherein the flap is formed for opening and closing an opening, through which ice is transportable from an interior of the housing out of the housing, wherein the module comprises plug elements and the housing comprises mating plug elements, and the plug elements are coupled to the mating plug elements to a plug connection such that the module is displaced linearly relative to the housing in defined manner by the relative movement between the plug elements and the mating plug elements in the further assembly of the module with the housing until the assembled final position of the module is achieved.

Further features of the invention are apparent from the claims, the figures and the description of figures. The features and feature combinations mentioned above in the description as well as the features and feature combinations mentioned below in the description of figures and/or shown in the figures alone are usable not only in the respectively specified combination, but also in other combinations without departing from the scope of the invention. Thus, implementations are also to be considered as encompassed and disclosed by the invention, which are not explicitly shown in the figures and explained, but arise from and can be generated by separated feature combinations from the explained implementations. Implementations and feature combinations are also to be considered as disclosed, which thus do not comprise all of the features of an originally formulated independent claim. Moreover, implementations and feature combinations are to be considered as disclosed, in particular by the implementations set out above, which extend beyond or deviate from the feature combinations set out in the relations of the claims.

BRIEF DESCRIPTION OF THE DRAWINGS

Below, embodiments of the invention are explained in more detail based on schematic drawings. There is shown.

DETAILED DESCRIPTION OF PREFERRED EMBODIMENTS

Figure 1:
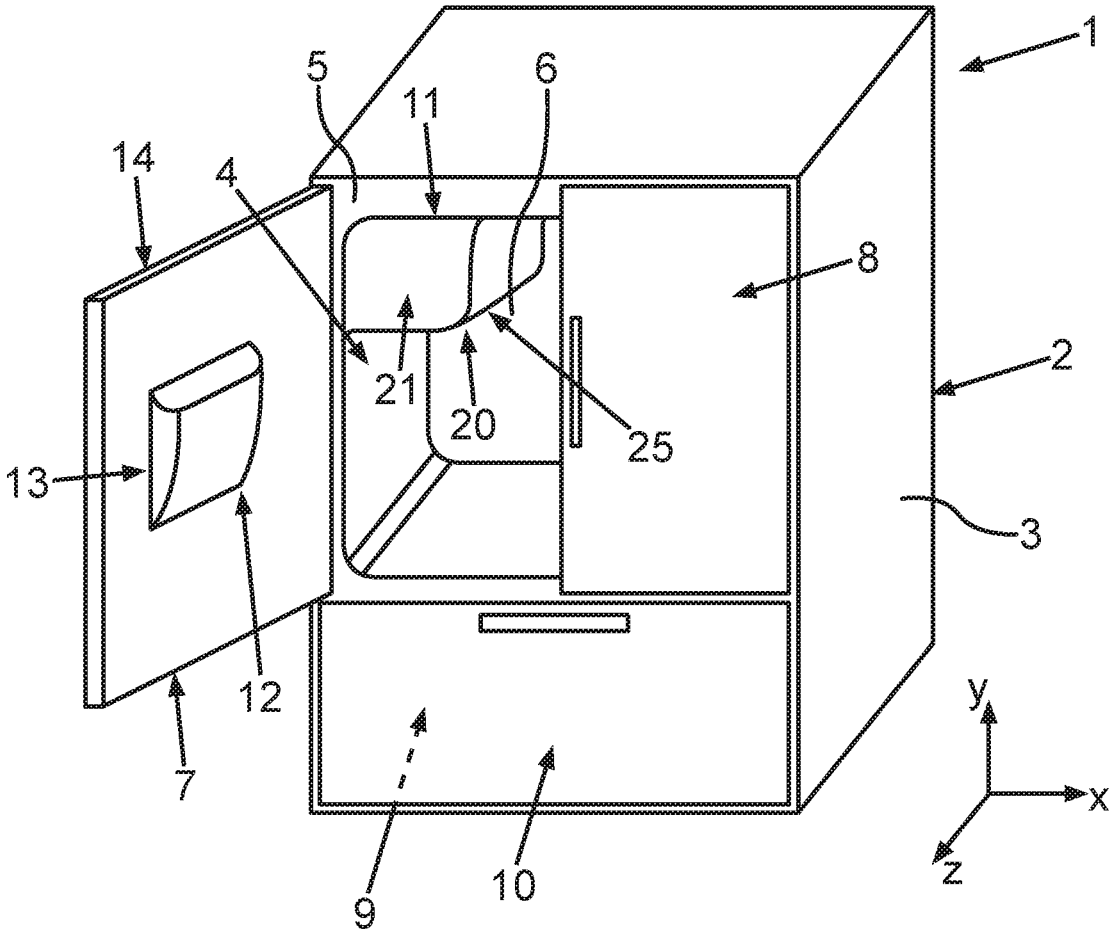
FIG. 1 a simplified perspective representation of an embodiment of a household refrigeration apparatus according to the invention.

In the figures, identical or functionally identical elements are provided with the same reference characters.

With indications of "top", "bottom", "front", "rear", "horizontal", "vertical", "depth direction", "width direction", "height direction", etc., the positions and orientations given in intended use and intended arrangement of the apparatus are specified.

In FIG. 1, a household refrigeration apparatus 1 is shown in a simplified representation, which is formed for storing and preserving food. The household refrigeration apparatus 1 comprises a housing 2. The housing 2 comprises an exterior housing 3. Moreover, the household refrigeration apparatus 1 comprises an interior container 4 separate from the exterior housing 3. The interior container 4 is received in the exterior housing 3. A thermally insulating material such as for example insulating foam and/or a vacuum insulating panel is arranged in a clearance 5 between the exterior housing 3 and the interior container 4.

In the embodiment, the interior container 4 bounds a receiving space 6 with its walls, which is formed for receiving food. Here, the receiving space 6 is in particular formed as a refrigerating compartment.

On the front side, the interior container 4 comprises a loading opening, via which food can be taken into or be removed from the receiving space 6. In the embodiment, the receiving space 6 is closable by two separate doors 7 and 8. The two doors 7 and 8 are pivotably arranged at the housing 2. The two doors 7 and 8 are arranged in the same height position viewed in height direction (y-direction) of the household refrigeration apparatus 1. In width direction (x-direction) of the household refrigeration apparatus 1, they are arranged next to each other such that they collectively close the receiving space 6 on the front side in the closed state. In particular, these two doors 7 and 8 are arranged in a common plane in the closed state, which is spanned by the height direction and the width direction.

In FIG. 1, the door 7 on the left side with front-side view is illustrated opened and the door 8 on the right side is illustrated closed.

Advantageously, the household refrigeration apparatus 1 comprises at least one further receiving space 9 for food. This further receiving space 9 is separated from the first receiving space 6. The further receiving space 9 can for example be a freezing compartment or a keep-fresh compartment or a further refrigerating compartment. Viewed in height direction, this further receiving space 9 is formed below the first receiving space 6. The further receiving space 9 is in particular bounded by further walls of an interior container, which can also be the interior container 4. Preferably, it is provided that the further receiving space 9 is bounded by a further door 10, which is shown in the closed state in FIG. 1. Preferably, it is provided that this door 10 is formed as a front plate of a drawer linearly retractable and extendable in depth direction (z-direction) of the household refrigeration apparatus 1.

It can be provided that the household refrigeration apparatus 1 comprises multiple, separate further receiving spaces 9, and further such explained drawers are preferably formed in this context. They can adjoin to the further receiving space 9 towards the bottom viewed in height direction. They are in particular also formed within the housing 2.

Further, the door 10, in particular this front plate, is arranged in the same plane as the doors 7 and 8 in the closed state of the doors 7, 8 and 10. In particular, the doors 7, 8 and 10 are front-side vision components of the household refrigeration apparatus 1. In particular, they are also, if they are closed, arranged without overlap with each other.

Moreover, the household refrigeration apparatus 1 comprises an ice maker 11. The ice maker 11 occupies a partial area of the volume of the receiving space 6 and is thermally insulated from the remaining volume of the receiving space 6. The ice maker 11 is formed to produce ice from water, which is supplied to the household refrigeration apparatus 1 via an external water supply line. In this context, ice form elements such as ice cubes or crushed ice can be produced.

Further, the ice maker 11 is a constituent of the dispenser unit 12 of the household refrigeration apparatus 1. In this advantageous implementation, the dispenser unit 12 comprises an output unit 13 in addition to the ice maker 11. This output unit 13 can preferably be formed at a door 7, 8. In the shown embodiment, the output unit 13 is arranged at the door 7. This is in particular advantageous because the ice maker 11 is arranged in the left upper corner area of the total volume of the receiving space 6 with front-side view of the household refrigeration apparatus 1. For outputting produced ice form elements, short paths are achieved by this local positioning. The output unit 13 is fixedly installed at the door 7. Moreover, the output unit 13 is separated from the ice maker 11 and also decoupled from it in this context. In the closed state of the door 7, ice form elements produced by the ice maker 11 can get into the output unit 13 and be output via a front side 14 of the door 7. Thereto, it is provided that a recess is formed on the front side 14, which faces away from the receiving space 6 in the closed state of the door 7. A vessel can be placed in this recess to be able to collect the output ice form elements.

Further, the dispenser unit 12 can also be formed for outputting liquid such as water or other drinks in addition to the output of ice form elements.

Figure 2:
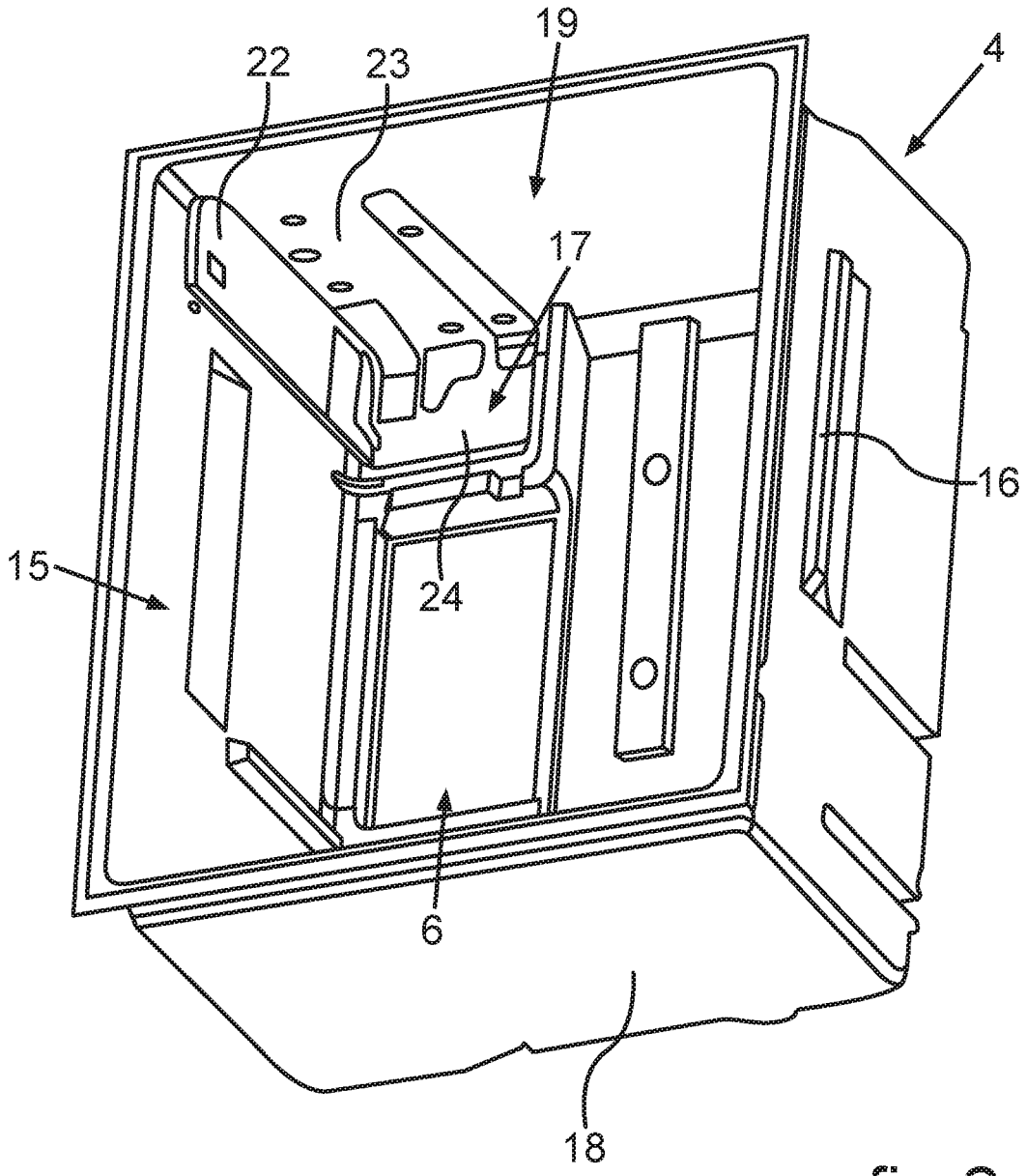
FIG. 2 a perspective representation of an embodiment of an interior container of the household refrigeration apparatus.

In FIG. 2, an embodiment of the interior container 4 is shown in a perspective representation. The interior container 4 is preferably integrally produced from plastic, for example by deep-drawing. Injection molding can also be provided.

The interior container 4 comprises multiple walls, which bound the receiving space 6. For example, the interior container 4 is formed with a first vertical side wall, which is a first wall 15 in the example, an opposing second vertical side wall 16, a rear wall 17, which is a third wall in the example, a bottom wall 18 and a ceiling wall, which is a second wall 19 in the example.

The first vertical side wall for example represents a first wall 15 of the interior container 4. In an embodiment, the ceiling wall represents a second wall 19 of the interior container 4, which is arranged angled, in particular at an angle of 90°, to the first wall 15.

The ice maker 11 comprises a housing 20 (FIG. 1). A receiving space 21 of this ice maker 11 is bounded by the housing 20. The housing 20 comprises a wall area 22 (FIG. 2) of the first wall 15 as a constituent. This wall area 22 is an upper wall area in the configuration according to FIG. 1 and FIG. 2. Moreover, a further constituent of the housing 20 of the ice maker 11 is formed by a wall area 23 of the second wall 19.

Moreover, the receiving space 21 is bounded by a further wall area 24. This further wall area 24 is an integral constituent of the rear wall 17 of the interior container 4. The wall areas 22, 23 and 24 directly join to each other.

Moreover, the housing 20 comprises a wall unit 25 (FIG. 1), which is a component separate from the interior container 4. This wall unit 25 is a further constituent of the housing 20 and bounds the receiving space 21 of the housing 20 in addition to the wall areas 22, 23 and 24.

Figure 3:
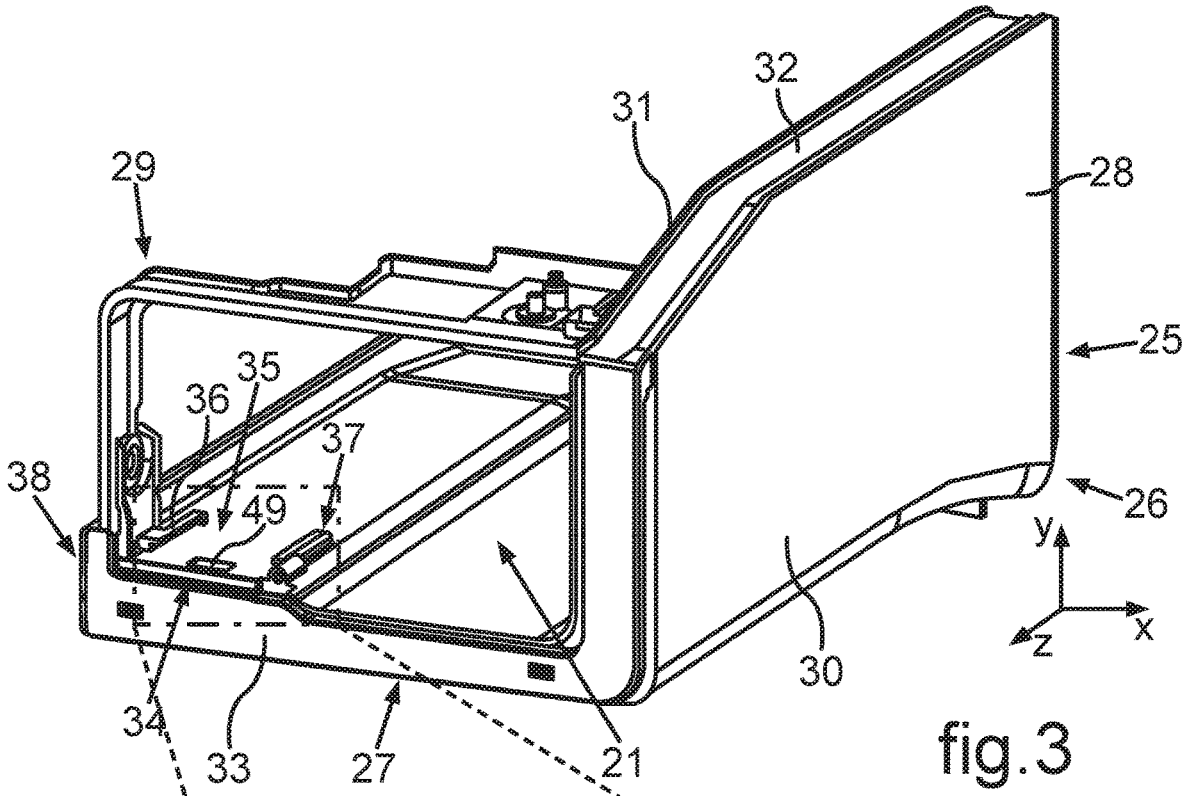
FIG. 3 a perspective representation of partial components of a housing of an ice maker, as it can be installed in the household refrigeration apparatus according to FIG. 1.

In FIG. 3, the wall unit 25 is shown in a perspective representation. It comprises a first wall plate 27 and a second wall plate 28, which form a plate unit 26. The two wall plates 27 and 28 directly join to each other and in particular at an angle of 90° to each other. The first wall plate 27 is in particular horizontally oriented and the second wall plate 28 is vertically oriented. In a vertical section, in which the sectional plane is formed by the width direction (x-direction) and the height direction (y-direction) of the household refrigeration apparatus 1 and also of the ice maker 11 in this context, this plate unit 26 has an L-shape.

In the shown embodiment, the wall unit 25 also comprises an L-shaped positioning bracket 29. It is connected to the wall plate 28 on the one hand and to the wall plate 27 on the other hand with its ends. In depth direction (z-direction), this positioning bracket 29 is arranged in a front area and thus in a front end of this wall unit 25. It bounds a front-side opening of this wall unit 25 with the front area of the wall plates 27 and 28. The wall plates 27 and 28 are formed with an integral, L-shaped outer wall element 30 and an L-shaped and integral inner wall element 31 separate therefrom. In a clearance between the outer wall element 30 and the inner wall element 31, a thermally insulating material 32 is introduced. Thereby, the receiving space 21 of the ice maker 11 is thermally insulated from the remaining volume of the receiving space 6. A front-side, also L-shaped end flange 33 covers this clearance between the outer wall element 30 and the inner wall element 31 on the front side.

As is apparent in FIG. 3, an assembly area 34 for a drive unit of the ice maker 11 is formed at the first wall plate 27, in particular at the inner wall element 31. The drive unit, which is not yet illustrated in FIG. 3, is formed for moving a flap. An opening can be closed by this flap, from which ice can be output from the housing 20 of the ice maker 11, in particular can be output into the output unit 13.

Components of a mechanically, non-destructively detachable connection 35 are formed in the assembly area 34. The connection 35 can be formed to the effect that it is only formed for directly plugging components together. However, this plug connection can additionally also be formed as a locking connection and a locking can then additionally be provided besides simply plugging together. Thus, a locking connection is in particular also understood by a plug connection.

This connection 35 comprises mating plug elements 36 and 37. These mating plug elements 36 and 37 are in particular formed integrally with the inner wall element 31. The mating plug elements 36 and 37 are formed as plug rails in the embodiment. They are oriented parallel to each other and extend linearly in depth direction. Moreover, it is provided that the assembly area 34 is formed in the front area viewed in depth direction of the housing 21. In particular, this assembly area 34 and thus also the connection 35 to the mating plug elements 36 and 37 is formed in a front third of length of the wall unit 25. This means that these mating plug elements 36 and 37 are formed in a front third of length of this entire length of the wall unit 25 upon length view of the wall unit 25 in depth direction. In particular, the mating plug elements 36 and 37 are thus formed in a front third of length of the housing 21 and thus also of the entire ice maker 11.

In an implementation, it is provided that the mating plug elements 36 and 37 are formed in a corner area 38 with front-side view of the wall unit 25 and thus with view in depth direction. In particular, this corner area 38 is a left-side, lower corner area with this front-side view.

Figure 4:
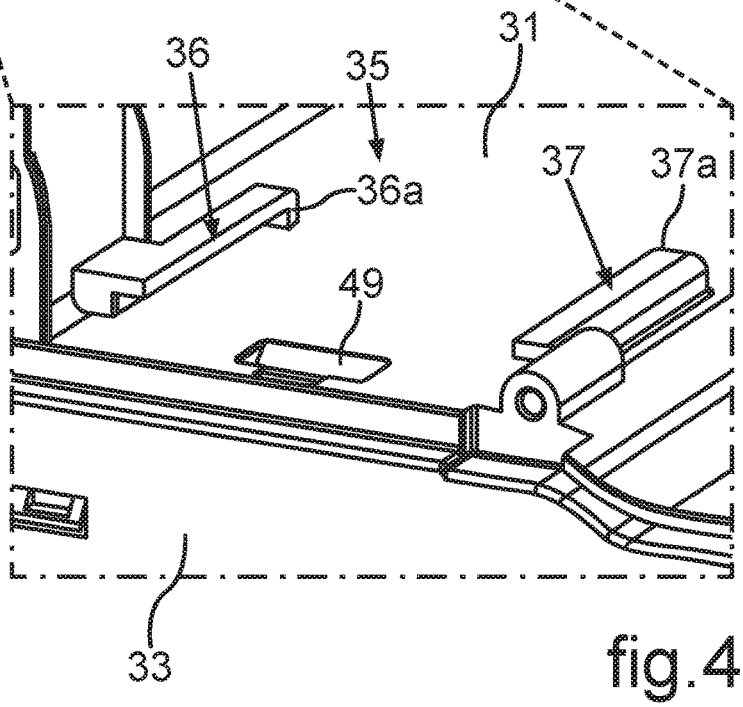
FIG. 4 an enlarged partial representation of FIG. 3.

In FIG. 4, that partial area of the representation in FIG. 3 is shown enlarged, in which the mating plug elements 36 and 37 are formed. As is apparent, these mating plug elements 36 and 37 each comprise a rear stop 36*a*, 37*a*. These stops 36*a*, 37*a* thus limit the depth of this plug-in length. The plug elements of the plug connection not shown in FIG. 3 and FIG. 4 can be plugged in over this plug-in length and thus be mechanically coupled to these mating plug elements 36 and 37.

Figure 5:
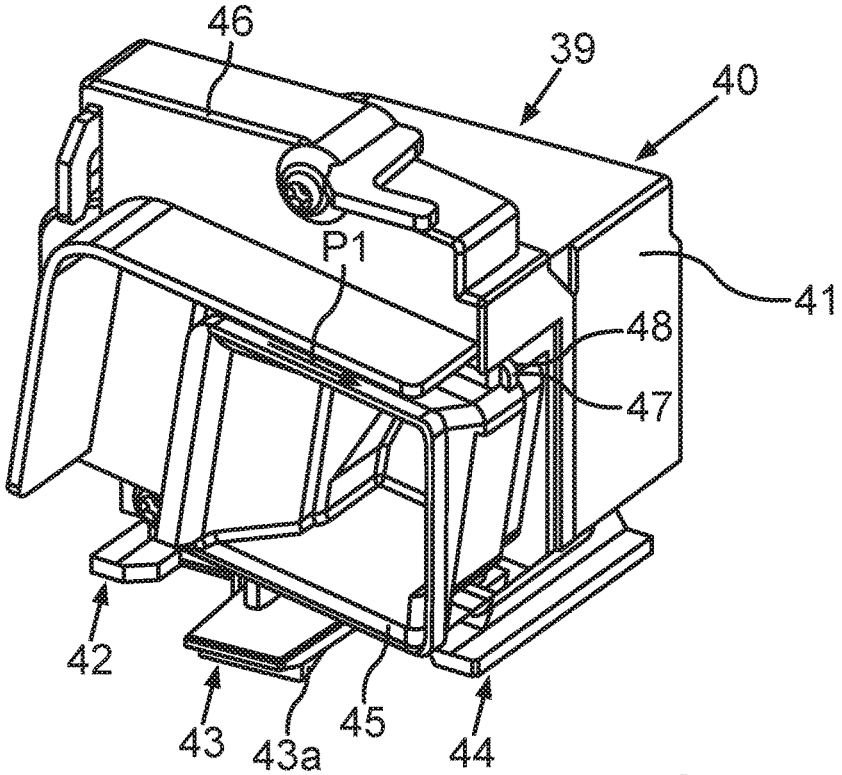
FIG. 5 a perspective representation of a drive unit of the ice maker.

In FIG. 5, a drive unit 39 of the ice maker 11 is shown in a perspective representation. This drive unit 39 is constructed as a compact module 40. This drive unit 39 comprises a module housing 41. It is in particular formed of plastic. The module housing 41 advantageously comprises plug elements 42, 43 and 44 formed integrally therewith. These separate plug elements 42 to 44 are a further constituent of the plug connection 35. In particular, the plug elements 42, 44 are formed as plug runners in the embodiment.

They are formed in a lower area of the module housing 41.

The drive unit 39 moreover comprises an actuating element or actuator 45. The actuating element 45 is a separate component, which is movably arranged. Here, it is in particular linearly displaceable. Here, the actuating element 45 is arranged obliquely inclined and thus can be moved on an obliquely inclined linear guiding track relative to a retaining unit 46 of the drive unit 39. Here, the actuating element 45 is formed as a duct-like box. The direction of movement of the actuating element 45 relative to the retaining unit 46 is shown by the arrow P1.

Further, the actuating element 45 comprises at least one engagement element 47, which is guided in a guiding groove 48 of the retaining unit 46. In particular, an upper engagement element 47 and a lower engagement element 47 as well as an upper guiding groove 48 and a lower guiding groove 48 are formed.

As is moreover apparent in FIG. 3 and FIG. 4, the connection 35 comprises a receptacle 49. The receptacle 49 is formed in the inner wall element 31 and formed between the mating plug elements 36 and 37 viewed in width direction.

Figure 6:
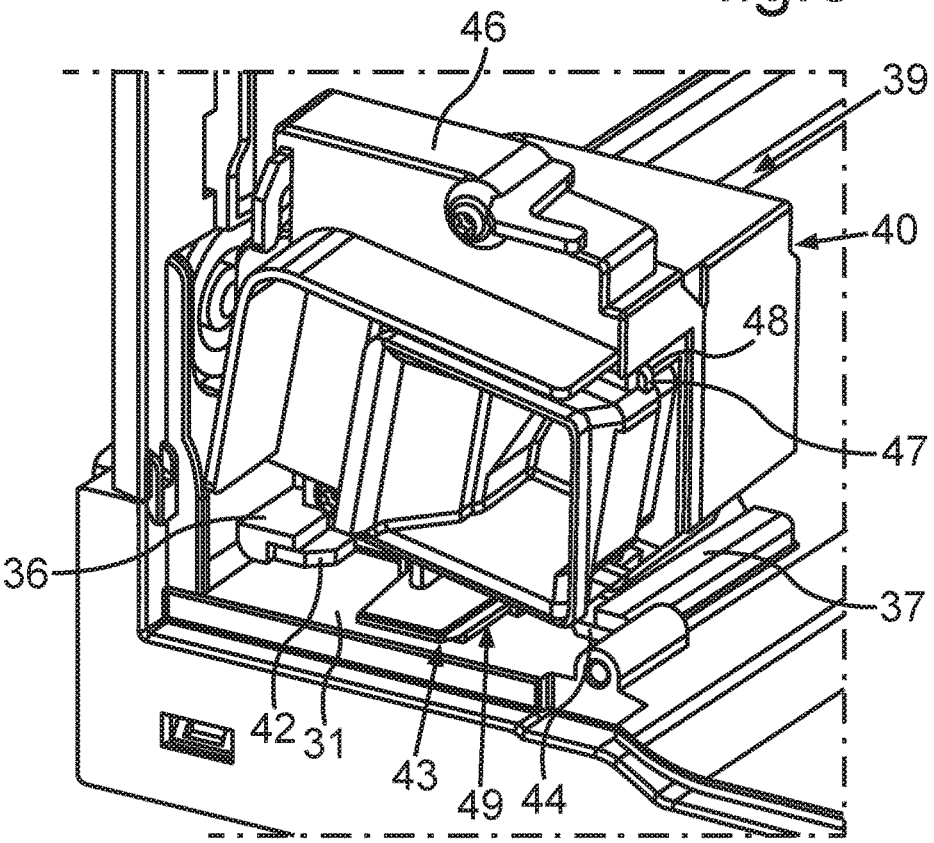
FIG. 6 an assembled state of the drive unit according to FIG. 5 in a partial area of the housing according to FIG. 3 and FIG. 4.

In FIG. 6, the assembled state of the module 40 at the wall unit 25 is shown in a perspective representation. Thus, the drive unit 39 is arranged in a front area of the housing 21, in particular in a front third of length of this housing 20. As it is apparent in FIG. 6, a secure retention is achieved by the mechanical coupling of the plug elements 42, 43 to the mating plug elements 36 and 37 and the receptacle 49. In particular, it is provided that the drive unit 39 and thus the module 40 are arranged at the wall unit 25 only by this connection 35. Additional separate fixing elements such as for example screws or the like are not provided.

As is apparent in FIG. 6, the plug element 42 formed as a plug runner is coupled to the mating plug element 36 and inserted into it up to the stop 36*a*. The further plug element 44 formed spaced thereto is inserted into the mating plug element 37, in particular up to the stop 37*a*.

Such a configuration would already be sufficient to allow the secure retention of the module 40 at the wall unit 25. In an advantageous implementation, it is provided that the element 43 is present in addition to these plug elements 42, 44 and the mating plug elements 36 and 37. It is preferably formed with a locking element 43*a*. This locking element 43*a* plunges into the receptacle 49 in the assembled state, as it is shown in FIG. 6, and snaps therein or locks therein. An even better positional fixing of the module 40 at the wall unit 25 is thereby achieved. Thus, secure positioning of the module 40 at the wall unit 25 is in particular achieved in all three spatial directions. In particularly advantageous manner, simple detachment of the module 40 from the assembled final position shown in FIG. 6 is also allowed.

In that the element 43 is actuated at its front-side edge, in particular upward bent, this snapped or locked state can be detached and then the module 40 can be forward pulled by a movement linear viewed in depth direction.

In the assembly, thus, this module 40 is provided and the wall unit 25 is also provided. For assembling this drive unit 39 to the wall unit 25, this module 40 is displaced into the wall unit 25 coming from the front. Thereto, the plug elements 42 and 44 are coupled to the mating plug elements 36 and 37. Upon then guided linear displacement of the module 40 in depth direction to the rear, the plug elements 42 and 44 are moved until they have reached the stops 36*a* and 37*a*. Snapping of the locking element 43*a* in the receptacle 49 is then also automatically achieved on this movement path.

Figure 7:
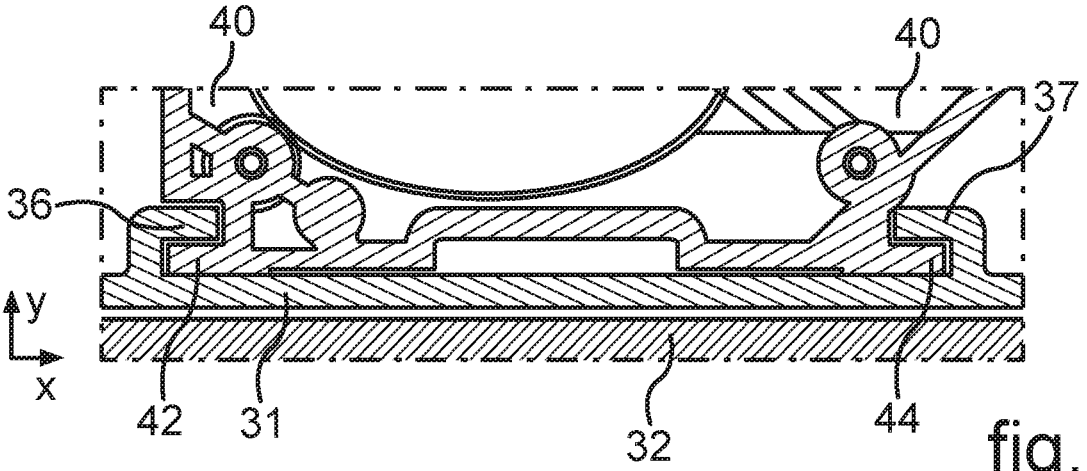
FIG. 7 a sectional representation through a partial area of the configuration according to FIG. 6.

In FIG. 7, the module 40 is shown in the assembled state in a vertical sectional representation. This vertical section is formed in a rear area of the module 40 such that the snapped state of the locking element 43*a* in the receptacle 49 is not apparent.

Figure 8:
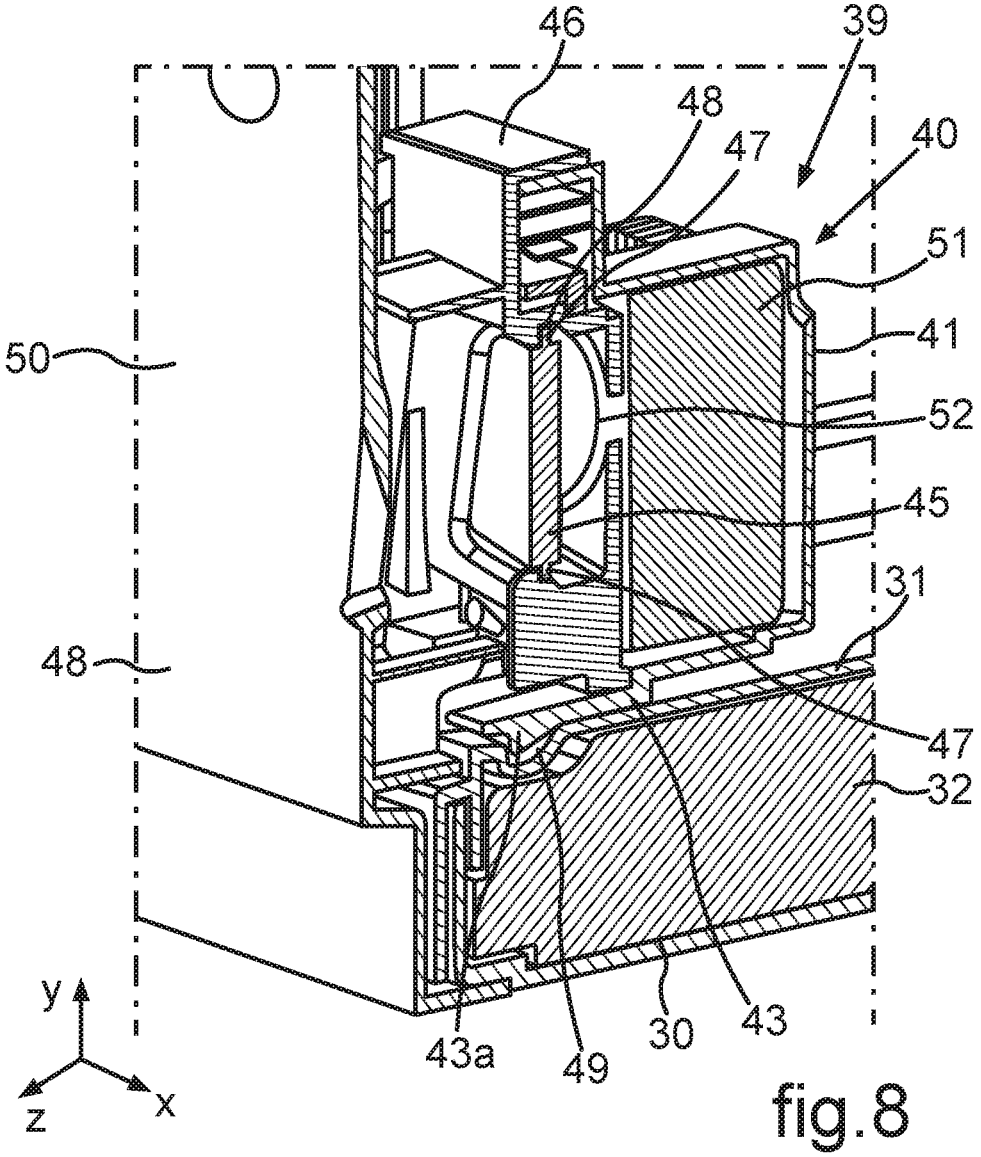
FIG. 8 a further sectional representation through the configuration according to FIG. 6 with additionally assembled front cover.

In FIG. 8, the wall unit 25 with the module 40 assembled thereto is shown in a further vertical sectional representation. Here, the sectional plane is given by the height direction and the depth direction. Moreover, the sectional representation in FIG. 8 is also perspectively shown. In contrast to the representation according to FIG. 6, moreover, a front-side cover 50 is additionally illustrated, which represents a front-side frame. The front flange 33 and the positioning bracket 29 are covered on the front side by this cover 50.

In this representation, the snapped state between the locking element 43*a* of the element 43 and the receptacle 49 is shown.

Moreover, it is also apparent that the drive unit 39 comprises a motor 51, which is arranged in the module housing 41. In the embodiment, it is provided that the drive unit 39 moreover comprises a cam 52. The cam 52 is coupled to the motor 51. On the other hand, the cam 52 is coupled to the actuating element 45. The cam 52 is set in a rotational movement by the motor 51. By this rotational movement, the actuating element 45 is actuated. Therein, the coupling between the cam 52 and the actuating element 45 is such that the rotational movement of the cam 52 is converted to a linear movement according to the arrow P1.

Figure 9:
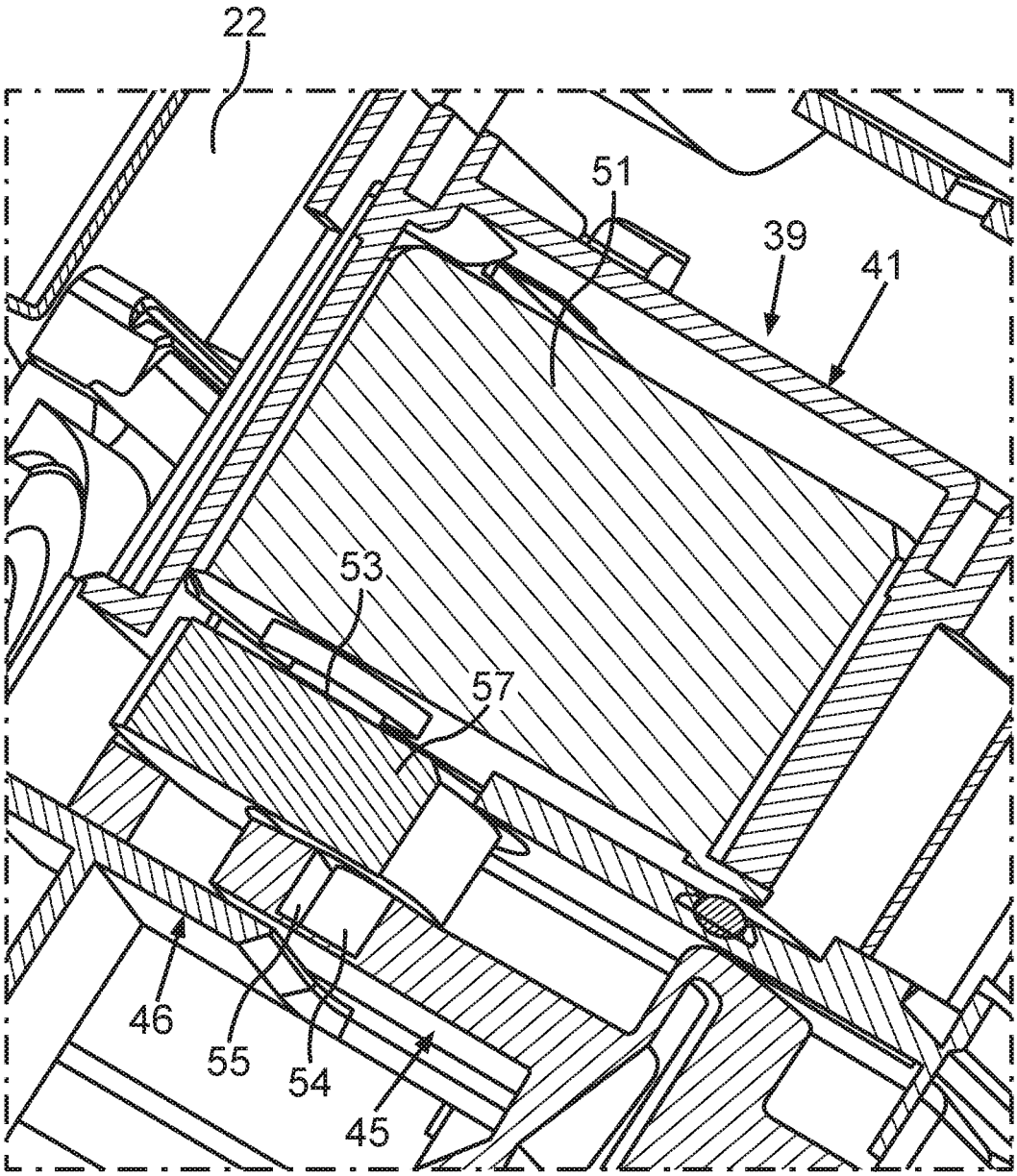
FIG. 9 a horizontal sectional representation through the assembled drive unit with the representation of specific partial components.

In FIG. 9, the drive unit 39 is shown in a horizontal sectional representation. As is here apparent, a shaft 53 of the motor 51 engages with the cam 52. The cam 52 comprises a pin-like coupling element 54, which engages with a receptacle 55 of the actuating element 45.

Figure 10:
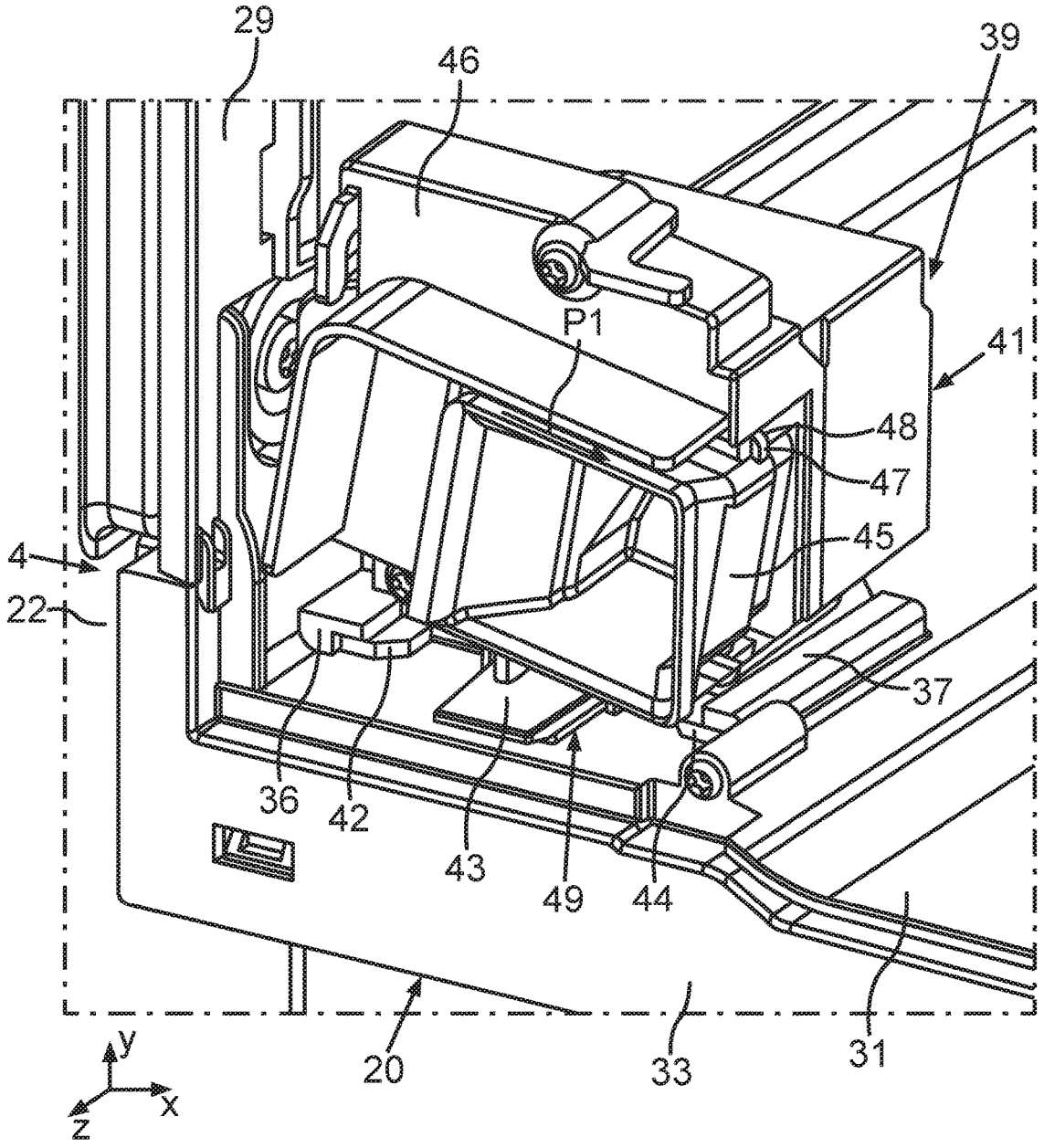
FIG. 10 a further perspective representation, in which the configuration according to FIG. 6 is installed in the interior container of the household refrigeration apparatus.

In FIG. 10, the housing 20 of the ice maker 11 is shown in a further perspective representation. Therein, the wall unit 25 is assembled to the interior container 4 in the upper left corner area. In particular, the actuating element is also guided in the lower area by the coupling between a guiding groove or guiding track 48 and an engagement element 47, as it is shown in FIG. 8.

Figure 11:
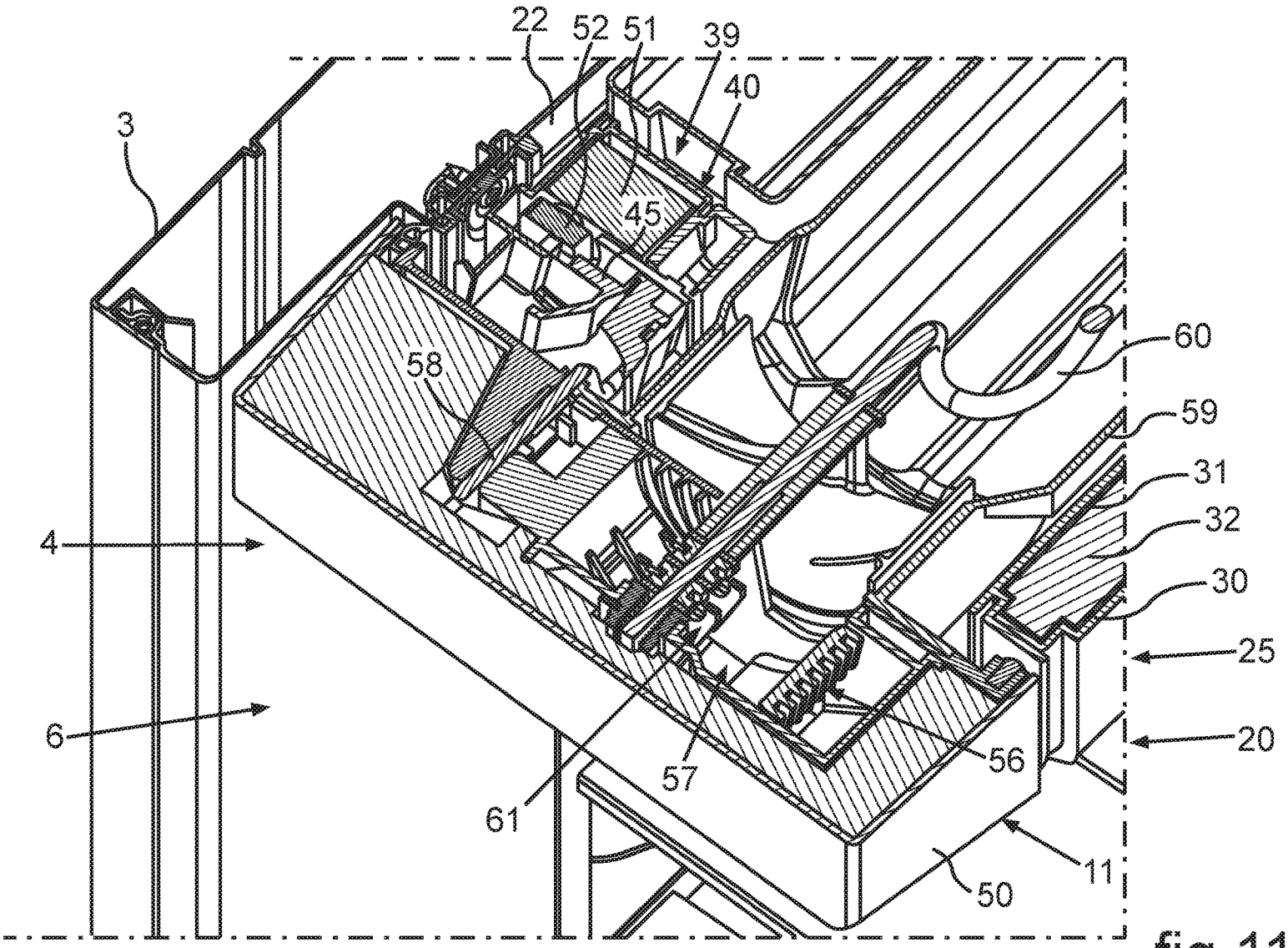
FIG. 11 a horizontal sectional representation through the household refrigeration apparatus in the area of the ice maker.

In FIG. 11, a partial area of the household refrigeration apparatus 1 is illustrated in a horizontal sectional representation (the sectional plane is formed by the width direction and the depth direction). The ice maker 11 is shown in the installed state in the household refrigeration apparatus 1. As is apparent, the module 40 is arranged in a near area to a flap 56. The flap 56 is an ice flap, which closes or unblocks an opening 57 of the housing 20. The flap 56 is movably arranged and movable by the drive unit 39. As is in particular apparent in FIG. 11, this flap 56 is arranged in a front area of the ice maker and thus also of the housing 20. The module 40 is arranged directly adjacent to this flap 56, which is preferably also located in the front third of the length of the housing 20 measured in depth direction. By this immediately adjacent arrangement between the module 40 and the flap 56, very short paths arise, to be able to actuate this flap 56 by the drive unit 39 via mechanical coupling. As is apparent in this context, the ice maker 11 comprises a very short lever rod 58. This lever rod 58 is directly connected to the actuating element 45. On the other hand, this lever rod 58 is connected to the flap 56.

In the representation according to FIG. 11, a container or a collecting pan 59 is furthermore shown. The produced ice form elements, in particular the ice cubes, can be stored in the ice maker 11 in this collecting pan 59 until they can be transported out of the housing 20. Thereto, a screw conveyor 60 is provided. The ice form elements can be transported forward into the collecting pan 59 viewed in depth direction by this screw conveyor 60 until they get into the opening 57. If it is to be provided that these ice form elements are crushed and for example crushed ice is produced, these ice form elements are crushed by a crushing device 61, which is arranged adjacent to the opening 57.

The flap 56 is opened or closed depending on need such that the ice form elements or the crushed ice can be output via the opening 57 or this is prevented.

As is moreover apparent in FIG. 11, the module 40 is arranged next to this collecting pan 49 viewed in width direction (x-direction). Thus, the module 40 is arranged directly adjacent and lateral to this collecting pan 59 viewed in width direction. Viewed in depth direction, the module 40 is arranged overlapping with the collecting pan 59 in particular over its entire length. Thereby, a compact construction of the housing 20 is achieved in depth direction.

Figure 12:
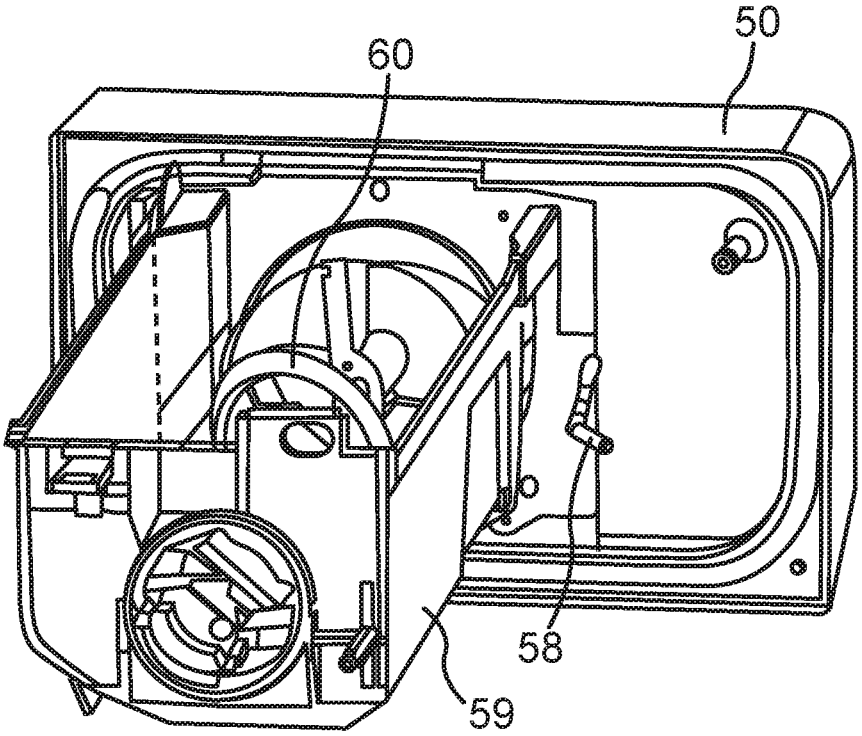
FIG. 12 a perspective view from behind to partial components of the ice maker.

In FIG. 12, an arrangement of multiple components of the ice maker is shown in a perspective representation viewed from behind. The lever rod 58 is shown.

Figure 13:
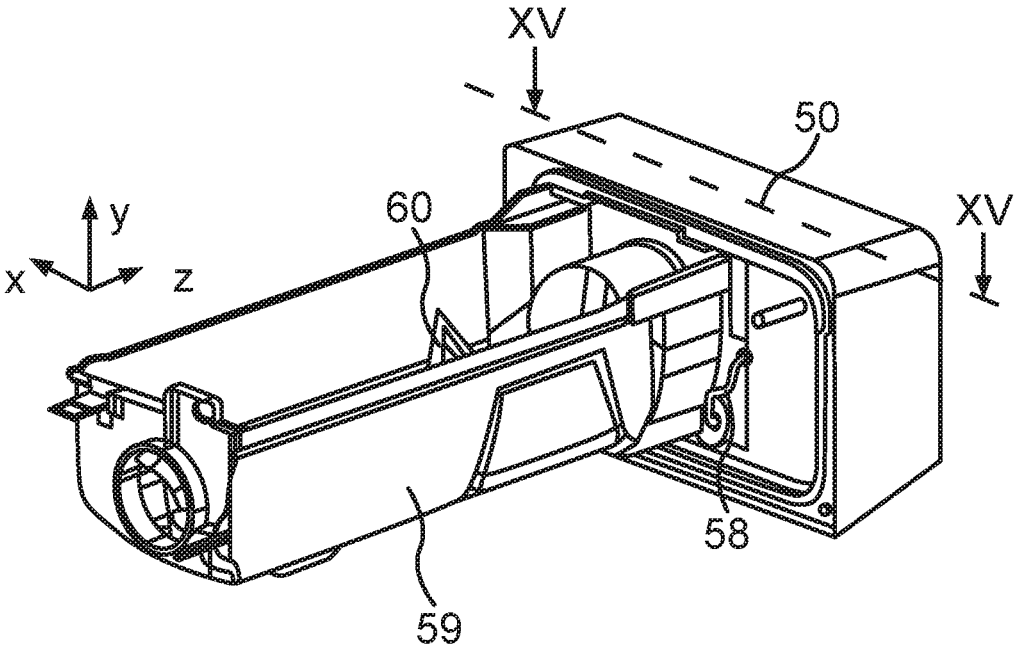
FIG. 13 the representation according to FIG. 12 in a perspective different from FIG. 12.

In FIG. 13, the configuration of the components according to FIG. 12 is shown in a perspective different from FIG. 12.

Figure 14:
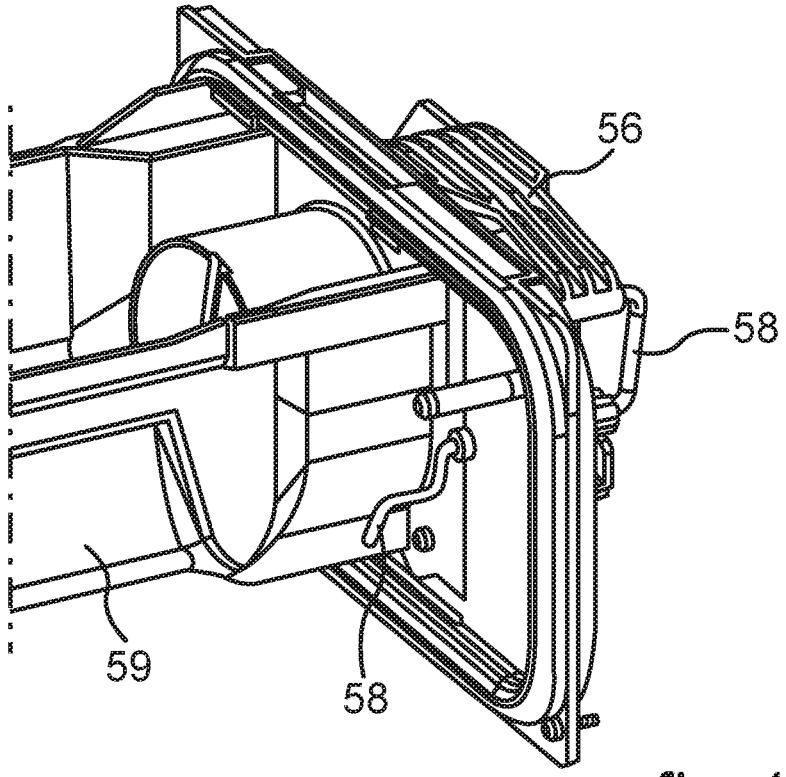
FIG. 14 an enlarged representation of partial components of the arrangement in FIG. 13.

In FIG. 14, partial elements of the representation in FIG. 13 are shown, wherein the front cover 50 is removed hereto. Here, the flap 56 is shown with its upper area. The lever rod 58 is also illustrated.

Figure 15:
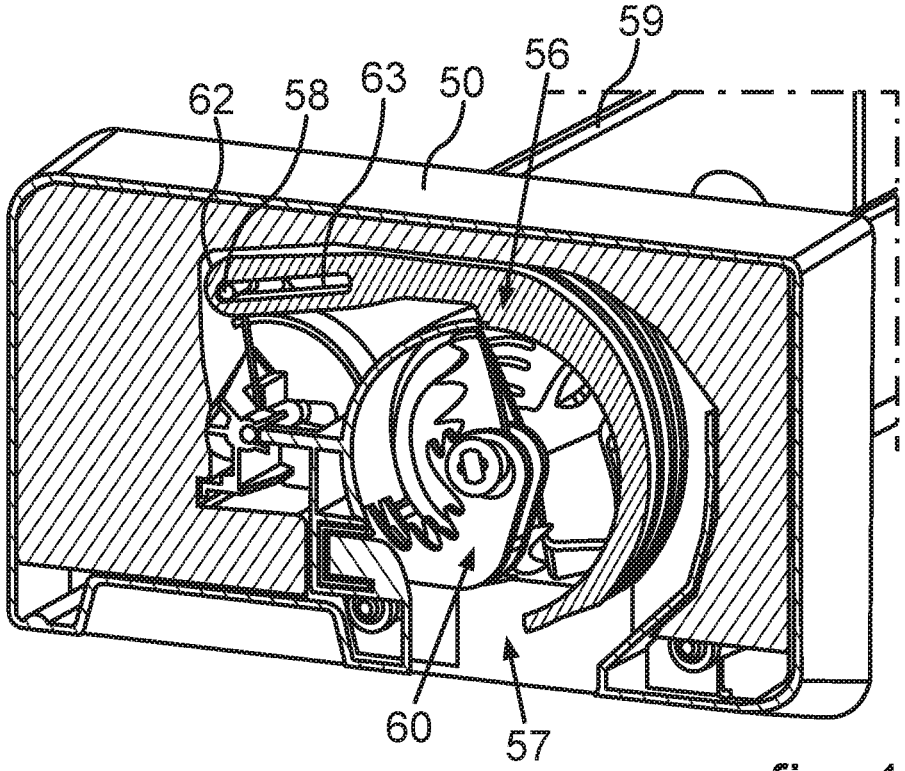
FIG. 15 a perspective vertical sectional representation through the arrangement of the components according to FIG. 13.

In FIG. 15, the arrangement is shown in a perspective sectional representation along the sectional line XV-XV in FIG. 13. This flap 56 comprises a receptacle 63 at its end 62 facing away from the opening 57 and facing the module 40. The lever rod 58 engages with this receptacle 63. In particular, this receptacle 63 is formed as an elongated hole. By the movement transmission of the movement of the cam 52 to the actuating element 45, the lever rod 58 coupled thereto is actuated, in particular rotated, such that by the coupling of the lever rod 58 to the flap 56, this flap 56 is moved between the opened position and the closed position.

Figure 16:
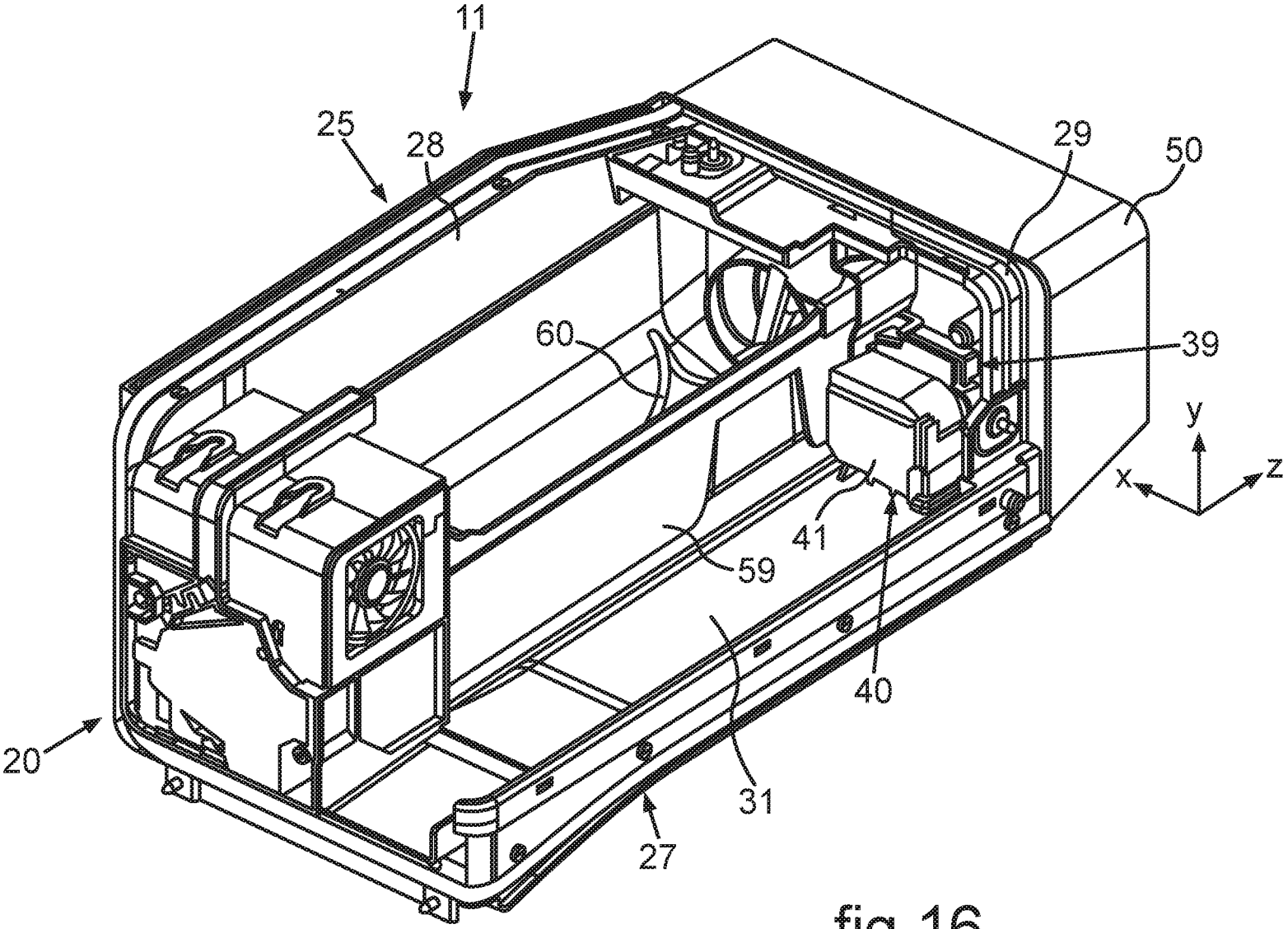
FIG. 16 a perspective representation to partial components of the ice maker.

In FIG. 16, the ice maker 11 is shown with partial components. These partial components are shown in a perspective representation with view from behind. In this perspective representation, the front-side position of the entire module 14 immediately in the near area to the flap 56 is apparent. Here, the arrangement of the module 40 in the front third of length of the length of the housing 20 measured in depth direction is in particular also apparent.

Figure 17:
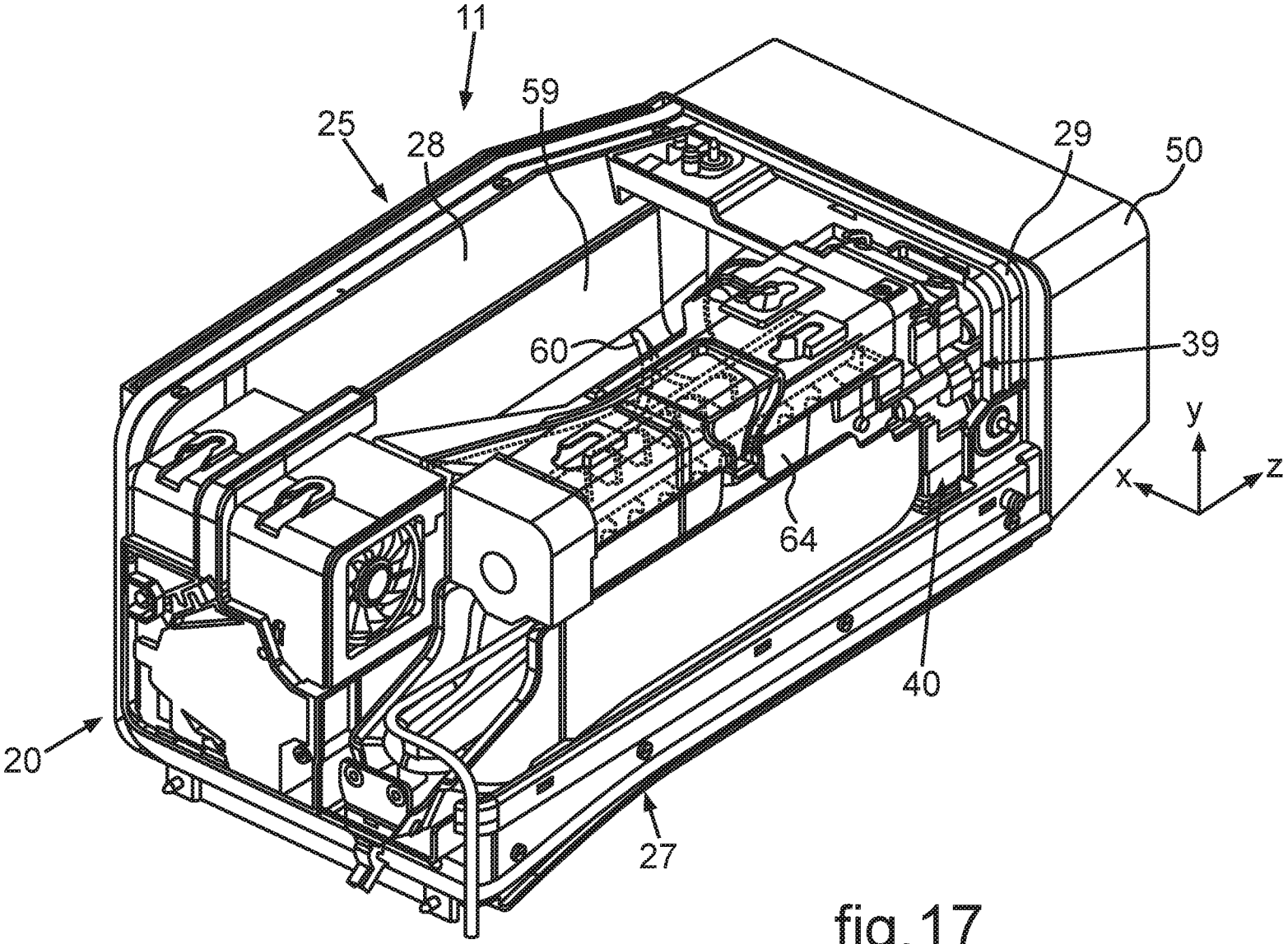
FIG. 17 a representation according to FIG. 16 with additionally assembled components of the ice maker.

In FIG. 17, the representation according to FIG. 16 is shown, wherein additional further components of the ice maker 11 are installed in the housing 20 in FIG. 17. In particular, this is an ice form tray 64, into which water can be introduced. The water introduced into form areas of this ice form tray 64 freezes. The thus produced ice form elements can then be removed from the ice form tray 64 and be introduced into the collecting pan 59. In particular, the lever rod 58 is a coupling rod. The coupling rod is in turn a constituent of a coupling device or coupler, by which the drive unit 39 is mechanically coupled to the flap 56.

In a further embodiment, the housing has a depth direction, and the opening is arranged in a front third of depth of the entire depth of the housing and the module of the drive unit is arranged in this front third of depth. Preferably, the housing has a depth direction, and the housing comprises a front flange, wherein the module is arranged adjacent to the front flange. Preferably, the housing has a depth direction, and the module is arranged in a front-side corner area of the interior of the housing with front-side view of the ice maker in this depth direction. Preferably, the module is arranged in a left lower, front-side corner area of the interior.

In a further embodiment, the ice maker comprises a collecting pan for ice form elements, wherein the collecting pan is arranged in the housing and the module of the drive unit is arranged laterally directly next to the collecting pan viewed in width direction of the ice maker.

In a further embodiment, the coupling device comprises a coupling rod, which is connected to the flap and to the module of the drive unit. In particular, the flap comprises an engagement slit at an end, with which the coupling rod engages. Preferably, the flap is formed shovel-like and curved. Preferably, the module of the drive unit comprises a module housing, which is non-destructively detachably arranged at the housing.

In a further embodiment, the module housing is fixed to the housing by a mechanical connection, which is a plug connection or a locking connection or a plug and locking connection. Preferably, the mechanical connection comprises at least one plug runner and one plug rail, which can be plugged together by a linear relative movement to each other.

In a further embodiment, the plug runner is formed integrally with the module housing and the plug rail is formed integrally with the housing.

In a further embodiment, the drive unit comprises a motor and an actuating element, which is coupled to the motor, wherein the actuating element is coupled to the flap.

List of Reference Characters

1 Household refrigeration apparatus
2 housing
3 exterior housing
4 interior container
5 clearance
6 receiving space
7 door
8 door
9 receiving space
10 door
11 ice maker
12 dispenser unit
13 output unit
14 front side
15 side wall
16 side wall

17 rear wall
18 bottom wall
19 ceiling wall
20 housing
21 receiving space
22 wall area
23 wall area
24 wall area
25 wall unit
26 plate unit
27 wall plate
28 wall plate
29 positioning bracket
30 outer wall element
31 inner wall element
32 thermally insulating material
33 end flange
34 assembly area
35 plug connection
36 mating plug element
**36*a*** stop
37 mating plug element
**37*a*** stop
38 corner area
39 drive unit
40 module
41 module housing
42 plug element
43 plug element
**43*a*** locking element
44 plug element
45 actuating element
46 retaining unit
47 engagement element
48 guiding groove
49 receptacle
50 cover
51 motor
52 cam
53 shaft
54 coupling element
55 receptacle
56 flap
57 opening
58 lever rod
59 container
60 screw conveyor
61 crushing device
62 end
63 receptacle
64 ice form tray

The invention claimed is:

1. A method for assembling an ice maker for a household refrigeration apparatus, comprising the following steps:

providing at least a partial area of a housing of the ice maker;

providing a drive unit of the ice maker as a separate module, using the drive unit for moving a flap of the ice maker, using the flap for opening and closing an opening, through which ice is transportable from an interior of the housing out of the housing for collection in a vessel outside the housing, providing the module with plug elements, providing the housing with mating plug elements, coupling the plug elements to the mating plug elements to form a mechanical connection, and displacing the module linearly relative to the housing by the relative displacement between the plug elements and the mating plug elements until an assembled final position of the module at the housing is achieved; and providing the housing with a receptacle formed therein, providing the module with a further plug element and engaging the further plug element in the receptacle.

2. The method according to claim 1, wherein the receptacle and the further plug element are disposed between the two rails and between the two plug runners.

3. An ice maker for a household refrigeration apparatus, comprising a housing having an opening, through which ice form elements are individually transportable from an interior of the housing out of the housing for collection in a vessel outside the housing;

the housing containing an ice collecting pan and a screw conveyor for transporting the ice form elements from the ice collecting pan to the opening;

a flap, which is movably arranged in the housing and is adjustable for closing or opening the opening;

a drive unit, which is coupled to the flap by a coupling of the ice maker, to move the flap, wherein the drive unit is formed as a separate module and an entirety of said module of the drive unit is arranged adjacent to the opening in the housing; and the module of the drive unit includes a module housing, which is non-destructively detachably disposed at the housing, the module housing is fixed to the housing by a mechanical connection which includes two plug runners and two plug rails which can be plugged together by a linear relative movement to each other, the housing has a receptacle formed therein and the module housing has a further plug element for engaging in the receptacle.

4. The ice maker according to claim 3, wherein the housing has a depth direction, and the opening is arranged in a front third of depth of the entire depth of the housing and the module of the drive unit is arranged in this front third of depth.

5. The ice maker according to claim 4, wherein the housing comprises a front flange, wherein the module is arranged adjacent to the front flange.

6. The ice maker according to claim 3, wherein the housing has a depth direction, and with front-side view of the ice maker in this depth direction, the module is arranged in a front-side corner area of the interior of the housing.

7. The ice maker according to claim 6, wherein the module is arranged in a left lower, front-side corner area of the interior.

8. The ice maker according to claim 3, wherein the module of the drive unit is arranged laterally directly next to the collecting pan.

9. The ice maker according to claim 3, wherein the coupling comprises a coupling rod, which is connected to the flap and the module of the drive unit.

10. The ice maker according to claim 9, wherein the flap comprises an engagement slit at an end, with which the coupling rod engages.

11. The ice maker according to claim 3, wherein the flap is shovel-shaped and curved.

12. The ice maker according to claim 3, wherein the two plug runners are formed integrally with the module housing, and the two plug rails are formed integrally with the housing.

13. The ice maker according to claim 3, wherein the drive unit comprises a motor and an actuator, which is coupled to the motor, wherein the actuator is coupled to the flap.

14. The ice maker according to claim 3, wherein the receptacle and the further plug element are disposed between the two plug runners and between the two plug rails.

15. A household refrigeration apparatus, comprising an apparatus housing formed with a receiving space for food, and an ice maker having:

a housing having an opening, through which ice form elements are individually transportable from an interior of the housing out of the housing for collection in a vessel outside the housing, the housing containing an ice collecting pan and a screw conveyor for transporting the ice form elements from the ice collecting pan to the opening, a flap movably arranged in the housing and adjustable for closing or opening the opening, a drive unit, which is coupled to the flap by a coupling of the ice maker, to move the flap, wherein said drive unit is formed as a separate module, and an entirety of said module of the drive unit is arranged adjacent to the opening in the housing;

the module of the drive unit includes a module housing, which is non-destructively detachably disposed at the housing, the module housing is fixed to the housing by a mechanical connection which includes two plug runners and two plug rails which can be plugged together by a linear relative movement to each other, the housing has a receptacle formed therein and the module housing has a further plug element for engaging in the receptacle.

* * * * *